US005218892A

United States Patent [19]

Napoli

[11] Patent Number: 5,218,892

[45] Date of Patent: Jun. 15, 1993

[54] PARKING METER SERVICE TOOL

[76] Inventor: Anthony Napoli, 1497 E. 51st St., Brooklyn, N.Y. 11234

[21] Appl. No.: 858,341

[22] Filed: Mar. 26, 1992

[51] Int. Cl.[5] ..... B25F 1/00

[52] U.S. Cl. ..... 81/440; 81/437; 81/450; 81/177.4; 7/168; 7/165

[58] Field of Search ..... 81/437–440, 81/450, 490, 177.6–177.9, 177.4; 7/165, 167, 168

[56] References Cited

U.S. PATENT DOCUMENTS

| | | | |
|---|---|---|---|
| 1,663,848 | 3/1928 | Koske | 7/168 X |
| 2,022,775 | 12/1935 | Holland-Letz | 81/439 |
| 3,186,009 | 6/1965 | Simmons | 7/165 X |
| 4,334,445 | 6/1982 | Timewell | 81/177.7 |
| 4,815,346 | 3/1989 | Littlehorn | 81/440 X |
| 4,979,574 | 12/1990 | Lalama et al. | 81/177.8 X |

*Primary Examiner*—D. S. Meislin
*Attorney, Agent, or Firm*—Michael I. Kroll

[57] ABSTRACT

A parking member service tool is provided, which consists of a body having a first end, a second end, a top surface, a bottom surface and lateral sides. A handle extends from the first end of the body. A elongated blade extends from the second end of the body. A first tool member is mounted to the body and is positioned at the top surface thereof. A second tool member is mounted to the body and is positioned at the bottom surface thereof.

10 Claims, 2 Drawing Sheets

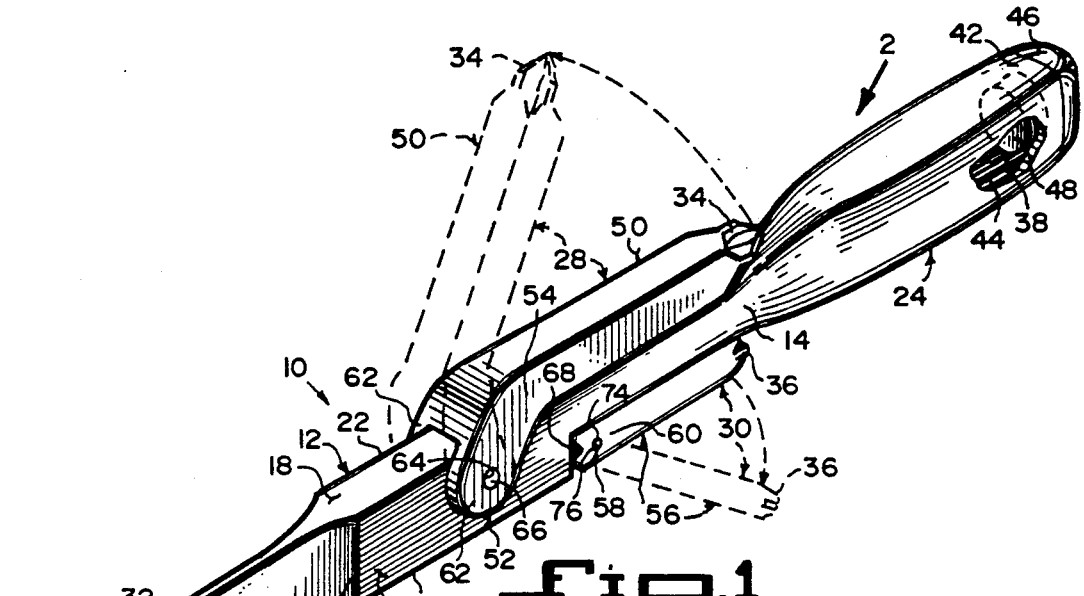
Fig. 1
Fig. 3
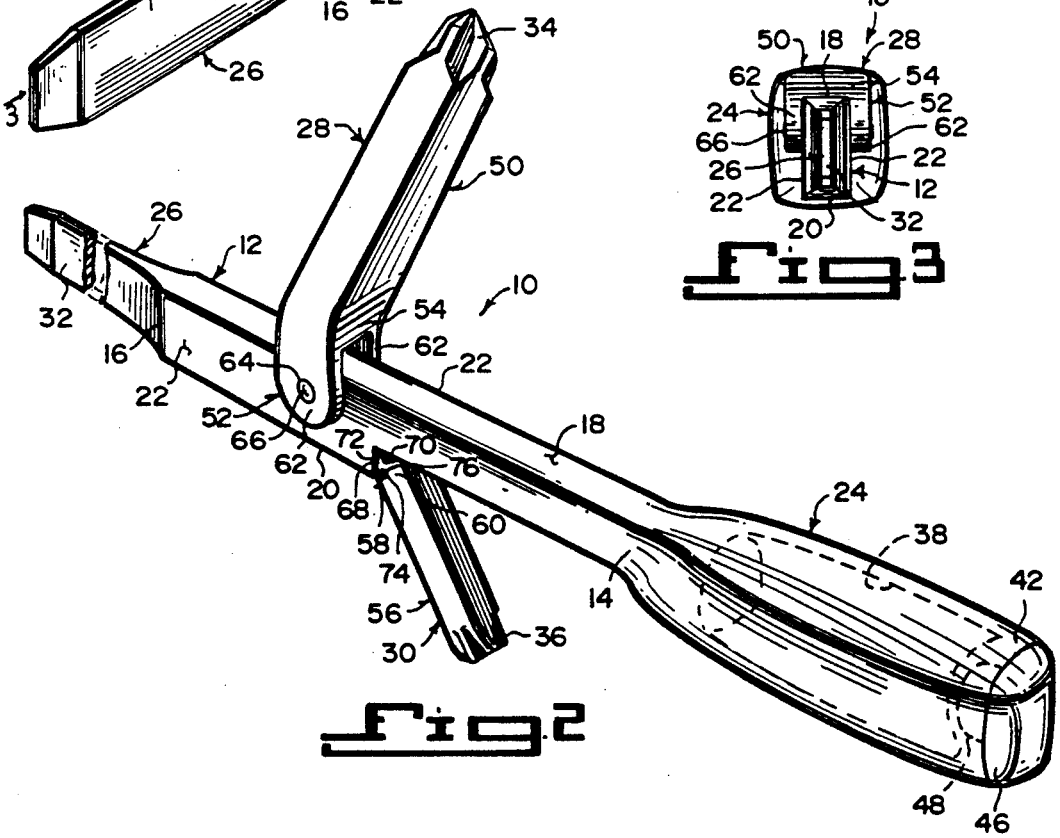
Fig. 2

PARKING METER SERVICE TOOL

BACKGROUND OF THE INVENTION

1. Field of the Invention

The instant invention relates generally to multipurpose tools and more specifically it relates to a parking meter service tool.

2. Description of the Prior Art

Numerous multipurpose tools have been provided in prior art that are adapted to perform a number of diverse functions for repair services commonly encountered at home and/or in the shop. While these units may be suitable for the particular purpose to which they address, they would not be as suitable for the purposes of the present invention as heretofore described.

SUMMARY OF THE INVENTION

A primary object of the present invention is to provide a parking meter service tool that will overcome the shortcomings of the prior art devices.

Another object is to provide a parking meter service tool that combines three different repair tools in one, which will allow a person to fix parking meters quickly, therefore the person can check out and repair more parking meters over a given time period.

An additional object is to provide a parking meter service tool that is small and compact, so that a person will always have easy access to the three different repair tools and can easily carry it from place to place.

A further object is to provide a parking meter service tool that is simple and easy to use.

A still further object is to provide a parking meter service tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of a first embodiment of the instant invention, with the handle broken out.

FIG. 2 is a rear perspective view taken in direction of arrow 2 in FIG. 1, with the blade broken.

FIG. 3 is a front view taken in direction of arrow 3 in FIG. 1.

DETAILED DESCRIPTION OF THE PREFERRED EMBODIMENTS

Figure 4:
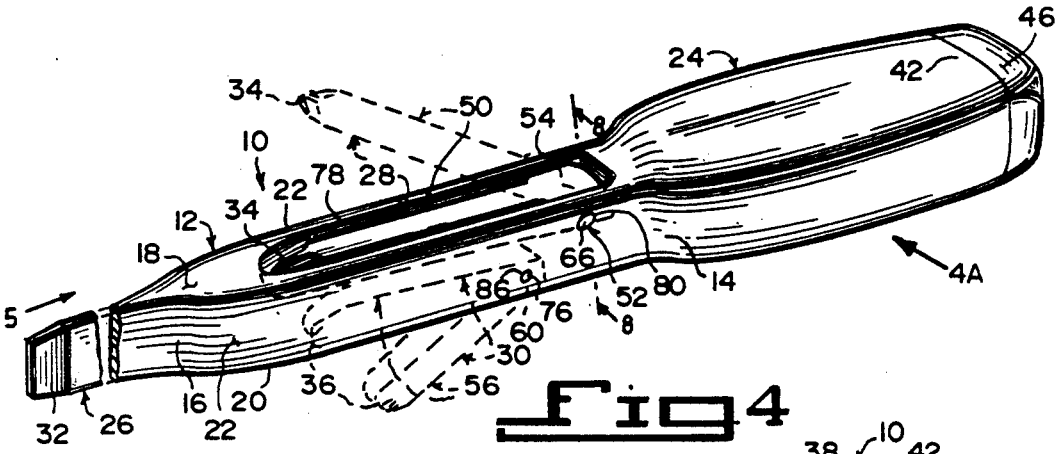
FIG. 4 is a front perspective view of a second embodiment of the instant invention with the blade broken.
Figure 4A:
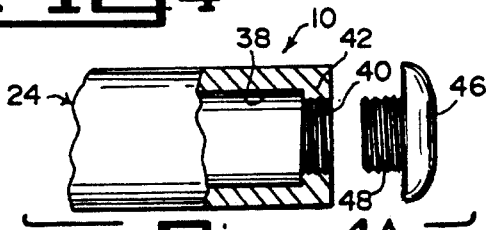
FIG. 4A is a side view taken in direction of arrow 4A in FIG. 4 with the screw cap exploded therefrom and a portion of the handle in section.

Turning now descriptively to the drawings, in which similar reference characters denote similar elements throughout the several views, the Figures illustrate a parking meter service tool 10, which consists of a body 12 having a first end 14, a second end 16, a top surface 18, a bottom surface 20 and lateral sides 22. A handle 24 extends from the first end 14 of the body 12. An elongated blade 26 extends from the second end 16 of the body 12. A first tool member 28 is mounted to the body 12 and is positioned at the top surface 18 thereof. A second tool member 30 is mounted to the body 12 and is positioned at the bottom surface 20 thereof.

The elongated blade 26 is a flat thin tongue 32 to be used in clearing jams in a parking meter. The first tool member 28 is a Phillips head screwdriver 34 to be used in loosening and tightening Phillips head screws in the parking meter. The second tool member 30 is a timer key 36 to be used in setting and adjusting a timer in the parking meter.

The handle 24, has a compartment 38 therein, with an internally threaded aperture 40 at its distal end 42 for holding small items 44 within the compartment 38.. A screw cap 46 has an externally threaded shank 48 to engage with the internally threaded aperture 40 in the distal end 42 of the handle 24 for retaining the small items 44 within the compartment 38.

The first tool member 28 has an elongated shank 50. A mechanism 52 is for pivotally mounting a distal end 54 of the elongated shank 50 of the first tool member 28 to the body 42. The first tool member 28 can swing away from the top surface 18 of the body 12 to be used and can swing back against the top surface 18 of the body 12 when not being used The second tool member 30 has an elongated shank 56. A mechanism 58 is for pivotally mounting a distal end 60 of the elongated shank 56 of the second tool member 30 to the body 12. The second tool member 30 can swing away from the bottom surface 20 of the body 12 to be used and can swing back against the bottom surface 20 of the body 12 when not being used.

The first pivotally mounting mechanism 52, shown in FIGS. 1 through 3, includes the body 12 having a transverse aperture (not shown), extending between the lateral sides 22 near the top surface 18. A pair of spaced apart lugs 62 are provided, with each having a hole 64 therethrough and formed on the distal end 54 on the elongated shank 50 of the first tool member 28. The lugs 62 can fit over the lateral sides 22 of the body 12 with the holes 64 in the lugs 62 in alignment with the transverse aperture in the body 12. A first pivot pin 66 extends through the holes 64 in the lugs 62 and the transverse aperture in the body 12.

Figure 5:
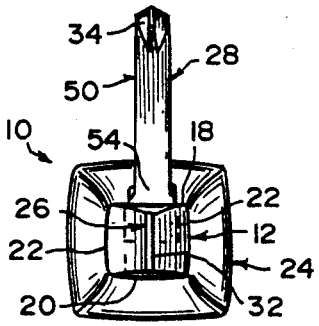
FIG. 5 is a front view taken in direction of arrow 5 in FIG. 4.
Figure 6:
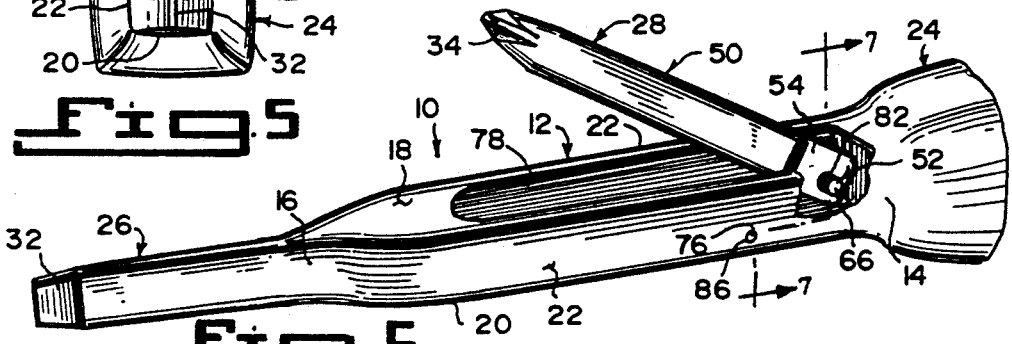
FIG. 6 is a front perspective view similar to FIG. 4 with parts broken away.
Figure 7:
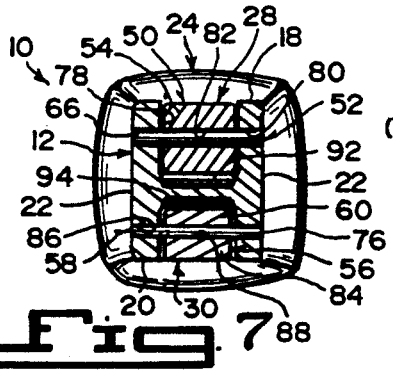
FIG. 7 is an enlarged cross sectional view taken along line 7—7 in FIG. 6.
Figure 8:
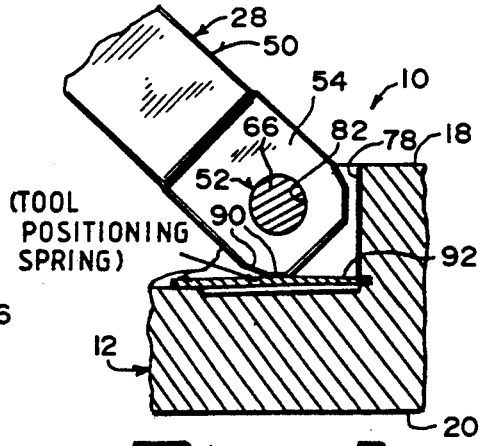
FIG. 8 is an even larger cross sectional view taken along line 8—8 in FIG. 4 with parts broken away.

The second pivotally mounting mechanism 58 includes the body 12 having a step back 68 in the bottom surface 20 with a lug 70 formed at the step back 68 and has a hole therethrough, not shown. The distal end 60 on the elongated shank 56 of the second tool member 30 has a slot 72 therein with a transverse aperture 74 extending therethrough. The slot 72 can fit over the lug 70 at the step back 68 on the body 12, with the transverse aperture 74 in the elongated shank 56 in alignment with said hole in the lug 70. A second pivot pin 76 extends through the transverse aperture 74 in the elongated shank 56 and the hole in the lug 70. The first pivotally mounting mechanism shown in FIGS. 4 through 8, includes the body 12 having an elongated slot 78 formed in the top surface 18, with a pair of aligned holes 80 in the lateral sides 22 adjacent the first end 14 which intersect with the elongated slot 7 in the top surface 18. The distal end 54 on the elongated shank 50 on the first tool member 28, has a transverse aperture 82 extending therethrough, so that the first tool member 28 can fit into the elongated slot 78 with the transverse aperture 82 in alignment with the holes 80 in the body 12. A first pivot pin 66 extends through the holes 80 in the body 12 and the transverse aperture 82 in the elongated shank.

The second pivotally mounting mechanism 58 includes the body 12 having an elongated slot 84 formed in the bottom surface 20, with a pair of aligned holes 86 in the lateral sides 22 adjacent the first end 14, which intersect with the elongated slot 84 in the bottom surface 22. The distal end 60 on the elongated shank 56 on the second tool member 30 has a transverse aperture 88 extending therethrough. The second tool member 30 ca fit into the elongated slot 84, with the transverse aperture 88 in alignment with the holes 86 in the body 12. A second pivot pin 76 extends through the holes 86 in the body 12 and the transverse aperture 86 in the elongated shank 56.

The first pivotally mounting mechanism 52 further includes the distal end 54 on the elongated shank 50 on the first tool member 28 having a plurality of flat areas 90 at one corner about the first pivot pin 66. A first tool positioning flat spring 92 is mounted within the elongated slot 78 in the top surface 18 of the body 12. When the first tool member 28 swings out from the elongated slot 78, the first flat spring 92 will make contact with one of the flat ares 90 on the distal end 54, to position the first tool member 28.

The second pivotally mounting mechanism 58 further includes the distal end 60 on the elongated shank 56 on the second tool member 30 having a plurality of flat areas (not shown) at one corner about the second pivot pin 76. A second tool positioning flat spring 94 is mounted within the elongated slot 84 in the bottom surface 20 of the body 12. When the second tool member 30 swings out from the elongated slot 84, the second flat spring 94 will make contact with one of the flat areas on the distal end 60 to position the second tool member 30.

LIST OF REFERENCE NUMBERS

10:parking meter service tool
12:body
14:first end on 12
16:second end on 12
18:top surface on 12
20:bottom surface on 12
22:lateral side on 12
24:handle
26:elongated blade
28:first tool member
30:second tool member
32:flat thin tongue
34:Phillips head screwdriver
36:timer key
38:compartment in 24
40:internally threaded aperture
42:distal end of 24
44:small items
46:screw cap
48:externally threaded shank on 46
50:elongated shank on 28
52:first pivotally mounting mechanism
54:distal end on 50
56:elongated shank on 30
58:second pivotally mounting mechanism
60:distal end on 56
62:lug
64:hole in 62
66:first pivot pin
68:step back on 20
70:lug at 68
72:slot in 60
74:transverse aperture in 60
76:second pivot pin
78:elongated slot in 18
80:hole in 22
82:transverse aperture in 54
84:elongated slot in 20
86:hole in 22
88:transverse aperture in 60
90:flat area on 54
92:first flat spring
94:second flat spring It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A parking meter service tool which comprises:

a) a body having first end, a second end, a top flat surface, a bottom flat surface and flat lateral sides;

b) a handle extending from said first end of said body and being larger than said body;

c) an elongated blade extending from said second end of said body and being as wide as said body, wherein said elongated blade is a flat thin tongue to be used in clearing jams in a parking meter;

d) a first tool member pivotally mounted to said body and positioned at said top surface thereof and yielding a Phillips screwdriver to be used in loosening and tightening Phillips head screws in a parking meter, when said first tool member is to be used it is totally extended from the tool body, said tool body fits in user's hand while said first tool member fits between the user's first two fingers and thus allowing more torque to be applied to said first tool member when turning, and in really difficult situations the handle of the tool fits in one hand while the flat thin tongue is held in the other hand and the first tool member is turned; and e) a second tool member pivotally mounted to said body and positioned at said bottom surface thereof and yielding a timer key to be used in setting and adjusting a timer in a parking meter, when said second tool member is to be used it is totally extended from the tool body, said tool body fits in user's hand while said second tool member fits between the user's first two finger and thus allowing more torque to be applied to said second tool member when turing, and in really difficult situations the handle of the tool fits in one hand while the flat thin tongue is held in the other hand and the second tool member is turned.

2. A parking meter service tool as recited in claim 1, further including:

a) said handle having a compartment therein, with an internally threaded aperture at its distal end for holding small items within said compartment, said compartment having said diameter greater than that of an internally threaded aperture; and b) a screw cap having an externally threaded shank to engage with said internally threaded aperture in said distal end of said handle for retaining small items within said compartment.

3. A parking meter service tool as recited in claim 2, further including:

a) said first tool member having an elongated shank; and b) means for pivotally mounting a distal end of said elongated shank of said first tool member to said body, so that said first tool member can swing away from said top surface of said body, to be used and can swing back against said top surface of said body when not being used.

4. A parking meter service tool as recited in claim 3, further including:

a) said second tool member having an elongated shank; and b) means for pivotally mounting a distal end of said elongated shank of said second tool member to said body, so that said second tool member can swing away from said bottom surface of said body to be used and can swing back against said bottom surface of said body when not being used.

5. A parking meter service tool as recited in claim 4, wherein first pivotally mounting means includes:

a) said body having a transverse aperture extending between said lateral sides near said top surface;

b) a pair of spaced apart lugs, each having a hole therethrough and formed on said distal end on said elongated shank o said first tool member, so that said lugs can fit over said lateral sides of said body with said holes in said lugs in alignment with said transverse aperture in said body; and c) a first pivot pin extending through said holes in said lugs and said transverse aperture in said body.

6. A parking meter service tool as recited in claim 5, wherein second pivotally mounting means includes:

a) said body having a step back in said bottom surface with a lug formed at said step back having a hole therethrough;

b) said distal end on said elongated shank of said second tool member having a slot therein with a transverse aperture extending therethrough, so that said slot can fit over said lug at said step back on said body, with said transverse aperture in said elongated shank in alignment with said hole in said lug; and c) a second pivot pin extending through said transverse aperture in said elongated shank and said hole in said lug.

7. A parking meter service tool as recited in claim 4, wherein first pivotally mounting means includes:

a) said body having an elongated slot formed in said top surface, with a pair of aligned holes in said lateral sides adjacent said first end which intersect with said elongated slot in said top surface;

b) said distal end on said elongated shank on said first tool member having a transverse aperture extending therethrough, so that said first tool member can fit into said elongated slot with said transverse aperture in alignment with said holes in said body; and c) a first pivot pin extending through said holes in said body and said transverse aperture in said elongated shank.

8. A parking meter service tool as recited in claim 7, wherein second pivotally mounting means includes:

a) said body having an elongated slot formed in said bottom surface, with a pair of aligned holes in said lateral sides adjacent said first end which intersect with said elongated slot in said bottom surface;

b) said distal end on said elongated shank on said second tool member having a transverse aperture extending therethrough, so that said second tool member can fit into said elongated slot, with said transverse aperture in alignment with said hole in said body; and c) a second pivot pin extending through said holes in said body and said transverse aperture in said elongated shank.

9. A parking meter service tool as recited in claim 8, wherein the first pivotally mounting means further includes:

a) said distal end on said elongated shank on said first tool member having a plurality of flat areas at one corner about said first pivot pin; and b) a first tool positioning flat spring mounted within said elongated slot in said top surface of said body, so that when said first tool member swings out from said elongated slot, said first flat spring will make contact with one of said flat areas on said distal end to position said first tool member.

10. A parking meter service tool as recited in claim 9, wherein the second pivotally mounting means further includes:

a) said distal end on said elongated shank on said second tool member having a plurality of flat areas at one corner about said second pivot pin; and b) a second tool positioning flat spring mounted within said elongated slot in said bottom surface of said body, so that when said second tool member swings out from said elongated slot, said second flat spring will make contact with one of said flat areas on said distal end to position said second tool member.

* * * * *